United States Patent [19]

Yoshieda

[11] Patent Number: 4,712,718

[45] Date of Patent: Dec. 15, 1987

[54] APPARATUS FOR ASSEMBLING PAIRS OF FASTENER ELEMENTS

[75] Inventor: Keiichi Yoshieda, Kurobe, Japan

[73] Assignee: Yoshida Kogyo, K. K., Tokyo, Japan

[21] Appl. No.: 896,063

[22] Filed: Aug. 13, 1986

[30] Foreign Application Priority Data

Aug. 16, 1985 [JP] Japan ..... 60-179290

[51] Int. Cl.[4] ..... B21J 15/10

[52] U.S. Cl. ..... 227/62; 227/155; 83/568

[58] Field of Search ..... 227/155, 142, 1-5, 227/8, 51, 53, 55, 61, 62; 100/231, 242, 257; 72/452, 481, 473; 83/685, 568

[56] References Cited

U.S. PATENT DOCUMENTS 4,351,467 9/1982 White ..... 227/142

4,378,900 4/1983 Sauermilch ..... 227/142

FOREIGN PATENT DOCUMENTS 470865 8/1937 United Kingdom ..... 227/61

*Primary Examiner*—E. R. Kazenske

*Assistant Examiner*—James L. Wolfe

*Attorney, Agent, or Firm*—Hill, Van Santen, Steadman & Simpson

[57] ABSTRACT

A fastener assembling apparatus includes an arrangement for adjustably setting a clinching force to be applied to a pair of fastener elements as they are clinched together by and between a punch and a die, thereby assembling the fastener elements in properly clinched condition without damaging the same. The clinching-force setting arrangement includes a spring-loaded slider block disposed in a lower horizontal portion of a generally C-shaped frame and slidably movable in a horizontal direction. The slider block has a downwardly sloping upper surface and is urged by a spring to hold the sloping upper surface in abutting engagement with an upwardly sloping lower surface of a die holder which is vertically movably disposed in the lower frame portion. The clinching-force setting arrangement also includes an adjustment rod disposed horizontally in the lower frame portion for adjusting the force of the spring. The clinching-force setting arrangement may include a further spring disposed in a ram for urging the punch downwardly, the punch being upwardly movable relative to the ram against the force of the spring, and a further adjustment rod for adjusting the force of the last-named spring.

7 Claims, 3 Drawing Figures

APPARATUS FOR ASSEMBLING PAIRS OF FASTENER ELEMENTS

BACKGROUND OF THE INVENTION

1. Field of the Invention:

The present invention relates to an apparatus for assembling a pair of fastener elements, such as a button body and a retainer of a garment button, in clinched condition with or without a garment fabric sandwiched therebetween.

2. Prior Art:

There are known various fastener assembling apparatus which comprise a reciprocable ram mounted on the upper portion of a frame and supporting thereon a punch, the ram being movable toward and away from a stationary die mounted on a lower portion of the frame, for assembling a pair of fastener elements in clinched condition with or without a garment fabric sandwiched therebetween. With this construction, the known apparatus has a clinching force which is determined by and equal to the maximum downward thrust of the ram. Since this downward thrust of the ram is always constant and not adjustable, the known apparatus can be usable only for assembling pairs of fastener elements of one kind. If the apparatus were used to assemble pairs of fastener elements of another kind having a different shape and thickness, an insufficient clinching of the fastener elements or a damage to the fastener elements or to the garment fabric would result.

SUMMARY OF THE INVENTION

It is accordingly an object of the present invention to provide an apparatus for assembling a pair of fastener elements in properly clinched condition with or without a garment fabric therebetween by a clinching force which is adjustable to adapt to the shape and thickness of the fastener elements to be clinched together.

According to the present invention, a fastener assembling apparatus comprises a clinching-force setting means for adjustably setting a clinching force to be applied to a pair of fastener elements in conformity with the shape and thickness of the fastener elements, thereby assembling the fastener elements in properly clinched condition with or without a garment fabric sandwiched therebetween. The clinching-force setting means includes a downwardly sloping lower surface of a die holder vertically movably disposed in a lower portion of a frame, a slider block disposed in the lower frame portion and slidably movable in a horizontal direction, the slider block having a downwardly sloping upper surface engageable with the sloping lower surface of the die holder, first spring means for urging the slider block toward the die holder to hold the sloping upper surface and the lower surface in abutting engagement with each other; and first means for adjusting the force of the first spring means. The clinching-force setting means may further include a punch holder mounted on a ram for holding the punch and vertically movable relative to the ram by a limited distance, a second spring means disposed in the ram for urging the punch holder to a lower end of the limited distance, and second means for adjusting the force of the second spring means. With the apparatus thus constructed, the clinching force can be adjusted in conformity with the shape and thickness of the fastener elements with the result that a damage free clinching of the fastener elements can be achieved.

Many other advantages, features and other objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
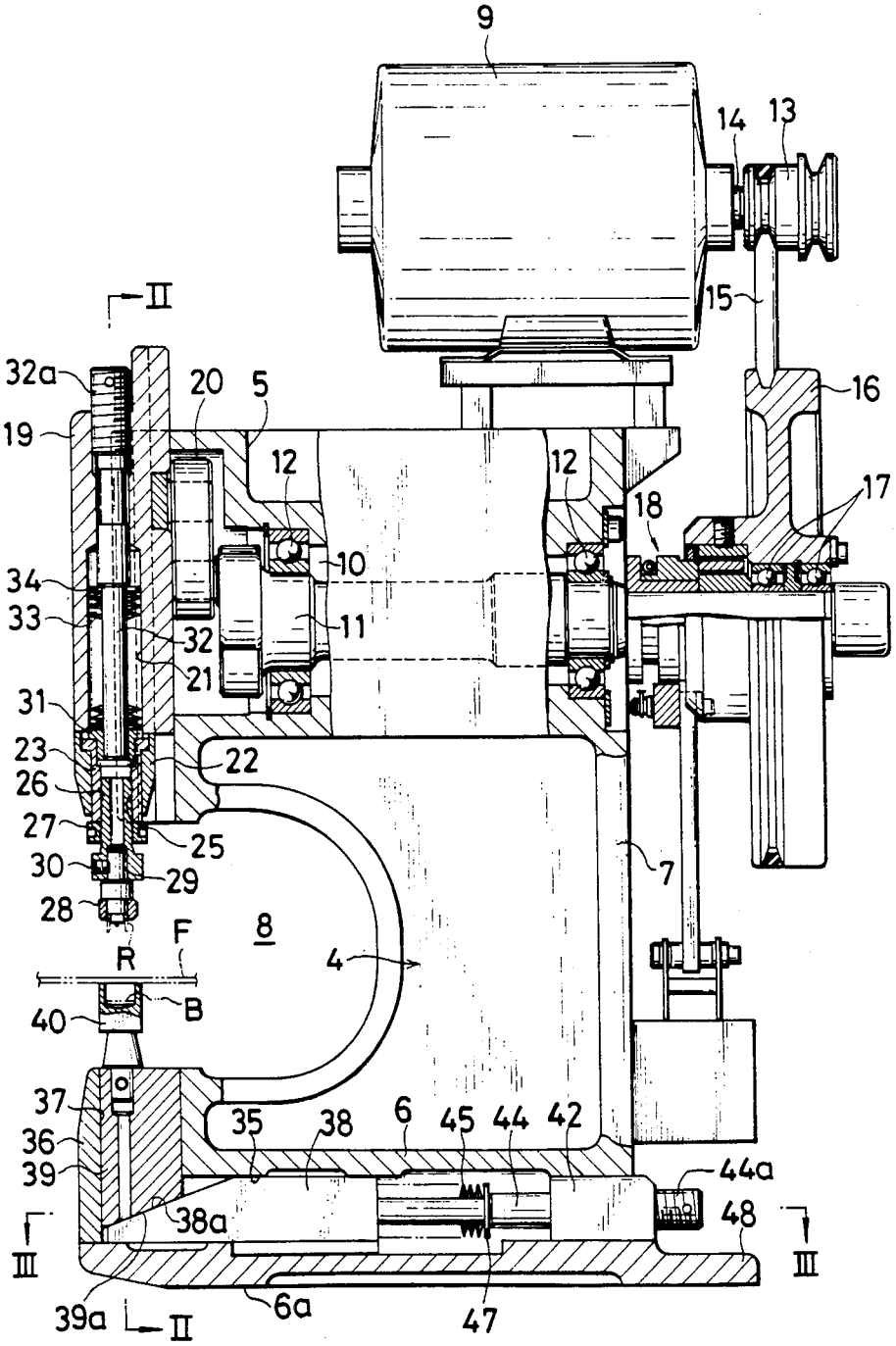
FIG. 1 is a side elevational, partially cross-sectional view of a fastener assembling apparatus embodying the present invention.

As shown in FIG. 1, a fastener assembling apparatus embodying the present invention includes a generally C-shaped frame 4 having a pair of upper and lower horizontal portions 5, 6 and an intermediate vertical portion 7 interconnecting the upper and lower frame portions 5, 6 with a punch-working space 8 defined therebetween. The upper frame portion 5 supports thereon an electric motor 9 and has, throughout the length thereof, a horizontal bore 10 in which a main shaft 11 is rotatably supported via a pair of roller bearings 12, 12. A primary pulley 13 is secured to a drive shaft 14 of the motor 9 for corotation therewith and is drivingly connected by an endless belt 15 to a secondary pulley 16 which is rotatably mounted on an end portion of the main shaft 11 by means of a pair of roller bearings 17, 17. The secondary pulley 16 has a diameter much larger than the diameter of the primary pulley 13 for multiplying a torque generated by the motor 9. A single revolution clutch 18 is mounted on the main shaft 11 adjacent to the secondary pulley 16 for intermittently connecting the secondary pulley 16 and the main shaft 11.

The fastener assembling apparatus further includes a reciprocable ram 19 vertically movably supported on a front end of the upper frame portion 5, the ram 19 being connected in driven relation to the main shaft 11 via a crank mechanism 20.

Figure 2:
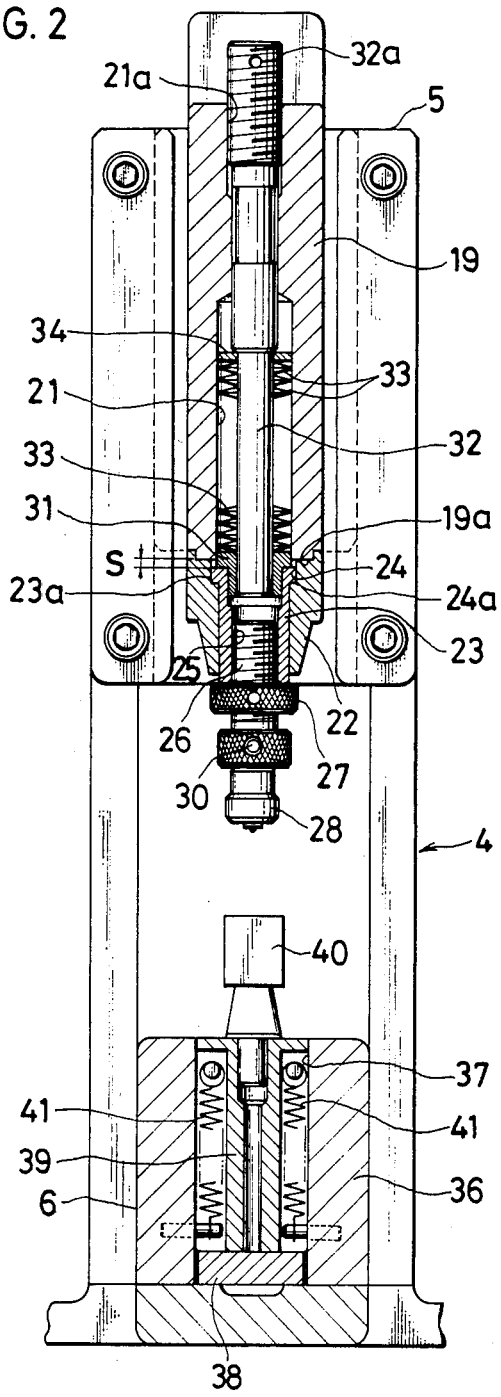
FIG. 2 is a cross-sectional view taken along line II—II of FIG. 1.

The ram 19, as shown in FIGS. 1 and 2, includes a vertical bore 21 extending longitudinally therethrough and is connected at its lower end by means not shown with an annular holder 22. A sleeve 23 is slidably fitted in the holder 22 and has an upper flange **23*a* received in an annular recess 24 defined in an inner peripheral wall of the holder 22. The recess 24 has a depth larger than the thickness of the flange 23*a* by a distance S so that the sleeve 23 is vertically movable by that distance. More specifically, the sleeve 23 is vertically movable between a lower position where the flange 23*a* is at rest on a step 24*a* between the annular recess 24 and an inner peripheral wall of the holder 22, and an upper position where the flange 23*a* is held in abutment with a lower end face 19*a* of the ram 19**.

The sleeve 23 includes an internally threaded lower portion 25 to which an externally threaded punch holder 26 is threaded. The punch holder 26 is locked in position to the sleeve 23 by a lock nut 27. A punch 28 is fitted in a central axial hole 29 in the punch holder 26 and is detachably connected to the punch holder 26 by a lock screw 30.

A flanged tubular spring retainer or seat 31 is fitted within an upper portion of the sleeve 23 and receives therein a lower end portion of an elongate adjustment rod 32 which is rotatably and slidably received in the vertical bore 21 in the ram 19. A multiplicity of conical disk springs 33 are disposed in the bore 21 are held between the spring retainer 31 and an upper spring seat 34 secured to an intermediate portion of the adjustment rod 32. The adjustment rod 32 has an externally threaded upper portion 32*a* threaded to an internally threaded upper portion 21*a* of the vertical bore 21. With this construction, by turning the adjustment rod 32 in either direction, the distance between the spring seats 24, 31 is changed, thereby adjusting a combined force of the springs 33 acting on the sleeve 23 via the spring seat 31.

Figure 3:
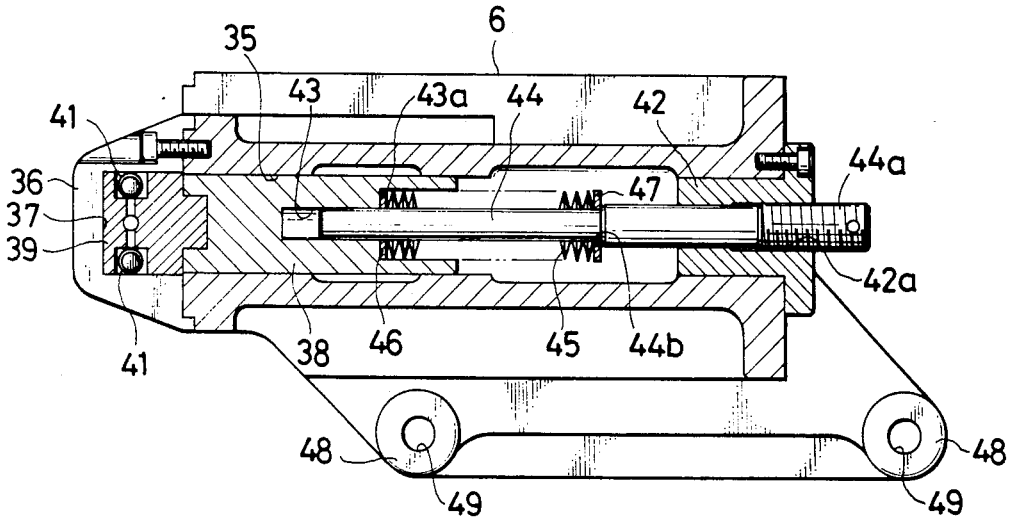
FIG. 3 is a cross-sectional view taken along line III—III of FIG. 1.

The lower frame portion 6 includes, as shown in FIG. 1, a horizontal bore 35 extending longitudinally therethrough, and a generally C-shaped front cover 36 secured to a front end of the lower frame portion 6 to close a front end of the horizontal bore 35. The cover 36 thus secured defines jointly with the frame portion 6 a vertical groove 37 communicating at its lower end with the horizontal bore 35. A slider block 38 is slidably received in the horizontal bore 35 and has a downwardly sloping upper surface 38*a* facing forewardly toward the cover 36. A die holder 39 is slidably received in the vertical groove 37 and has an upwardly sloping flat lower surface 39*a* resting flatwise on the sloping flat upper surface 38*a* of the slider block 38. The die holder 39 detachably supports thereon a die 40 and is urged downwardly by a pair of tension coil springs 41, 41 (FIG. 2). As best shown in FIG. 3, a tubular end bush 42 is fitted in a rear end of the horizontal bore 35 and is secured to the lower frame portion 6 by a plurality of screws (only one shown). The slider block 38 includes a stepped blind hole 43 opening toward the end bush 42 for slidably receiving therein a front end portion of an elongate adjustment rod 44. The adjustment rod 44 includes an externally threaded rear end portion 44*a* threaded to an internally threaded portion 42*a* of the end bush 42. A multiplicity of conical disk springs 45 are disposed around the adjustment rod 44 and are held between a pair of spring seats 46, 47. The spring seat 46 rests on an annular step 43*a* of the stepped blind hole 43 and the spring seat 47 rests on an annular shoulder 44*b* of the adjustment rod 44. With this construction, the slider block 38 is urged forwardly by the springs 45, a combined force of which is adjustable by turning the adjustment rod 44 in either direction to vary the distance between the spring seats 46, 47.

The lower horizontal frame portion 6 includes a flat bottom surface 6*a* (FIG. 1) and a pair of mounting side flanges 48, 48 (FIG. 3) having a pair of through-holes 49, 49, respectively, through which bolts (not shown) extend for mounting the fastener assembling apparatus on a table, also not shown.

The fastener assembling apparatus thus constructed operates as follows.

The electric motor 9 is driven to rotate the pulleys 13, 16. In this instance, the single revolution clutch 18 is de-energized so that rotary motion of the pulley 16 is not transmitted to the main shaft 11.

Then a retainer R and a button body B are held on the punch 28 and the die 40, respectively, and a garment fabric F is placed on the die 40 so that a portion of the garment fabric F is located above the button body B held on the die 40.

Thereafter, the single revolution clutch 18 is energized to connect the pulley 16 and the main shaft 11 whereupon the main shaft 11 is turned through an angle of 360 degrees. This rotary motion is converted by the crank mechanism 20 into a vertical reciprocation of the ram 19. Since the sleeve 23 is urged by the springs 33 downwardly against the holder 22, the downward movement of the ram 19 causes the punch 28 to descend, in unison with the ram 19, toward the die 40 for joining the retainer R and the button body B in clinched condition with the garment fabric F sandwiched therebetween. Such simultaneous descending movement of the punch 28 and the ram 19 continues until the springs 33 yield to a clinching force applied to the retainer R and the button B as they are clinched by the punch 28 and the die 40, whereupon the springs 33 are gradually compressed as the sleeve 23 moves upwardly relative to the ram 19. The clinching force progressively increases as the displacement of the springs 33 is increased in direct proportion to the upward displacement of the sleeve 23.

When the sleeve 23 is moved upwardly by the distance S (FIG. 2), the flange 23*a* of the sleeve 23 is brought into abutment with the lower end of the ram 19 whereupon the ram 19 and the sleeve 23 move downwardly in unison with each other, without the influence of the force of the springs 33.

During the clinching operation, the die 40 receives the clinching force acting thereon in a vertically downward direction. The vertically downwardly directed clinching force is transmitted from the die holder 39 to the slider block 38 via the sloping flat surfaces 39*a*, 38 where the direction of the clinching force is changed from the vertically downward direction to a downwardly oblique direction which is normal to the sloping surfaces 39*a*, 38*a*. The downwardly obliquely directed clinching force has a horizontal component force $F_2$ (not shown) acting on the slider block 38 for retracting the same against the force of the springs 45. This horizontal component force is obtained by the following equation:

$$F_2 = \tan\theta \times F_1$$

wherein $\theta$ is an angle of inclination of each sloping surface 38*a*, 39*a*, and $F_1$ is a vertically downwardly directed clinching force acting on the die holder 39. As appears from the foregoing equation, the horizontal component force $F_2$ is always smaller than the clinching force $F_1$.

When the clinching force $F_1$ is increased to such an extent that its horizontal component $F_2$ overcomes the combined force of the springs 45, the die 40 and the die holder 39 move downwardly to thereby force the slider block 38 rearwardly against the force of the springs 45. The clinching force gradually increases with the magnitude of rearward displacement of the slider block 38.

With the apparatus thus constructed, the clinching force can be adjusted stepwise by means of the sets of springs 33, 45. More specifically, if the punch 28 and the die 40 were mounted directly on the ram 19 and the lower frame portion 6, respectively, without the agency of the springs 33, 34, the clinching force would be determined by and become equal to the maximum downward thrust of the ram 19 and would be always constant and not adjustable. On the contrary, according to the invention, the clinching force is adjustable within a certain wide range below the maximum downward thrust of the ram 19 so that various pairs of fastener elements R, B of different shapes and thickness can properly be set on a garment fabric F without causing any damage to either fastener element R, B or to the garment fabric F. Adjustment of the clinching force can readily be effected by turning at least one of the adjustment rods 32, 44 to change the distance between the spring seats 31, 34 or 46, 47. Alternatively, such force-adjustment can be done by replacing the springs 33, 45 with those having different spring forces, or changing the angle of inclination of the sloping surfaces 38*a*, 39*a*.

Another advantage arises in that the die holder 39 is supported on the sloping upper surface 38*a* of the spring-loaded slider block 38 which is movable horizontally in the lower horizontal frame portion 6. With this construction, it is possible to minimize the thickness of the lower frame portion 6 to such an extent that only the die holder is vertically movable in such lower frame portion 6, the lower frame portion 6 having a flat bottom surface 6*a*. The apparatus having such lower frame portion is compact in construction as a whole and can readily be installed on a flat working table, not shown. Furthermore, since the slider 38 is reactive to a horizontal component of the clinching force, the springs 45 do not require a great resiliency and hence they can readily be assembled with or replaced from the lower frame portion 6.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for assembling a pair of fastener elements, comprising:

(a) a frame;

(b) a die holder vertically movably mounted on a lower portion of said frame and supporting thereon a die on which one of the fastener elements is supported, said die and said die holder being movable in unison with each other;

(c) a reciprocable ram mounted on an upper portion of said frame in confronting relation to said die and supporting thereon a punch on which the other fastener element is supported, said ram being vertically movable toward and away from said die to clinch the fastener elements together by and between said punch and said die; and (d) means for adjustably setting a clinching force to be applied to the fastener elements as they are clinched by said punch and said die, said clinching-force setting means including (1) a downwardly sloping lower surface of said die holer, (2) a slider block disposed in said lower portion of said frame and slidably movable in a horizontal direction, said slider block having a downwardly sloping upper surface engageable with said sloping lower surface of said die holder, (3) first spring means for urging said slider block toward said die holder to hold said sloping upper surface and said lower surface in abutting engagement with each other, (4) first means for adjusting the force of said first spring means, (5) a punch holder mounted on said ram for holding said punch and vertically movable in unison with said punch and relative to said ram by a limited distance, (6) second spring means disposed in said ram for urging said punch holder to a lower end of said limited distance, and (7) second means for adjusting the force of said second spring means.

2. An apparatus according to claim 1, said frame having a generally C-shaped configuration and including a lower horizontal frame portion, said lower frame portion having a vertical groove in which said die holder is slidably mounted, and a horizontal bore communicating at its one end with said vertical groove and holding therein said slider block, said first adjusting means including an adjustment rod disposed in said horizontal bore and axially movable toward and away from said slider block, said first spring means acting between said slider block and said adjustment rod.

3. An apparatus according to claim 2, further including an end bush secured to said frame to close the other end of said horizontal bore, said slider block including a hole opening toward said end bush, said adjustment rod having one end portion threaded to said end bush and the other end portion slidably received in said hole in said slider block.

4. An apparatus according to claim 2, said first spring means comprising a multiplicity of conical disk springs disposed around said adjustment rod.

5. An apparatus according to claim 1, said ram including a vertical bore, said second adjustment means comprising an adjustment rod disposed in said vertical bore and movable toward and away from said punch holder, said second spring means acting between said punch holder and said adjustment rod.

6. An apparatus according to claim 5, said adjustment rod having an end portion threaded to said ram.

7. An apparatus according to claim 5, said second spring means comprising a multiplicity of conical disk springs disposed around said adjustment rod.

* * * * *